United States Patent [19]

Da Costa

[11] Patent Number: 5,069,607

[45] Date of Patent: Dec. 3, 1991

[54] ROTARY ROLLING PISTON TYPE COMPRESSOR

[75] Inventor: Caio M. F. N. Da Costa, Joinville, Brazil

[73] Assignee: Empresa Brasileira de Compressores S/A -Embraco, Joinville, Brazil

[21] Appl. No.: 364,376

[22] Filed: Jun. 9, 1989

[30] Foreign Application Priority Data

Jun. 9, 1988 [BR] Brazil ..... PI8802894

[51] Int. Cl.[5] ..... F04C 18/00

[52] U.S. Cl. ..... 418/63; 418/248

[58] Field of Search ..... 418/63, 75

[56] References Cited

U.S. PATENT DOCUMENTS

| | | | |
|---|---|---|---|
| 1,931,198 | 10/1933 | Klabon | 418/63 |
| 2,155,756 | 4/1939 | Firestone et al. | 418/63 |
| 3,813,193 | 5/1974 | Rinehart | 418/63 |
| 4,537,567 | 8/1985 | Kawaguchi et al. | 418/63 |
| 4,629,403 | 12/1986 | Wood | 418/63 X |

FOREIGN PATENT DOCUMENTS

| | | | |
|---|---|---|---|
| 98191 | 6/1985 | Japan | 418/63 |

*Primary Examiner*—Michael Koczo
*Attorney, Agent, or Firm*—Darby & Darby

[57] ABSTRACT

A rotary rolling piston compressor having a hermetic shell in which a cylinder is fixedly mounted. A rolling piston is driven by a crankshaft supported by a bearing pair and carried by the rotor of an electric motor whose stator is fixed internally to the shell. The cylinder has a radial slot in which a vane reciprocates. The vane defines compression and suction chambers, limited axially by the internal faces of the bearings and the chambers having discharge and suction orifices, respectively. The internal face of at least one of the bearings is provided with a groove with one end in communication with the compression chamber and the part on the suction chamber side of the vane in communication with a recess provided on the radial slot surface, on the suction chamber side. The recess extends transversely to the direction of the reciprocating displacement of the vane. This arrangement causes the compression chamber pressure to be transmitted to the vane face turned to the suction chamber, while lubrication of this same side of the vane with the oil held within the groove and coming from the compression chamber is promoted.

3 Claims, 2 Drawing Sheets

ROTARY ROLLING PISTON TYPE COMPRESSOR

BACKGROUND OF THE INVENTION

The present invention relates to a rotary rolling piston compressor with fixed vane, and more specifically to a new construction for the sliding slot of the vane of this type of compressor.

In rotary rolling piston type compressors the fixed sliding vane causes the separation of two chambers in the interior of the cylinder into a suction chamber at low pressure and a compression chamber at high pressure. This separation is obtained as the vane tip follows the rolling piston movement under the bias of a spring. Due to the fact of separating two chambers with great pressure difference, the vane is forced against the surface of the slot in which it slides by the high pressure in the compression chamber. This causes problems concerning contact of metallic parts and wear between the sliding van and the slot.

One of the well-known solutions attempts to reduce this problem through the improvement of the vane lubrication system, especially in the place where the contact of metallic parts occurs. This is the case of the U.S. Pat. No. 4,629,403 (TECUMSEH). Another effort is to reduce the difference of pressure between the chambers at the end of the compression cycle according to U.S. Pat. No. 4,664,608 (G.E.).

Although these solutions reduce the wear between the vane and the slot, they cause losses in the volumetric efficiency of the compressor.

On the first mentioned solution (U.S. Pat. No. 4,629,403), the placement of a lubricating hole with oil at high pressure connected to the suction, or low pressure, chamber through the clearance for the sliding of the vane at the slot, causes leakage of this oil to the interior of the cylinder during the compression cycle. This increases the temperature of the refrigerant fluid in the suction chamber, reducing its volumetric efficiency.

On this first solution the aim is to reduce the vane and the slot wear through the lubricating provision on the places where the wear of the parts occurs. However, in spite of reducing the problem of vane and slot wear, this first solution requires a flow of the lubricating oil to a value that becomes detrimental to the compressor efficiency because it results in an undesirable heating of the refrigerant fluid held within the suction volume of the cylinder.

On the second solution (U.S. Pat. No. 4,664,608) the opening of the hole for the pressure release will always occur at a certain rotation angle of the crankshaft, whether the discharge pressure has been reached in the cylinder or not. This depends on the operational conditions in which the compressor is used. This may cause backflow of the refrigerant gas already discharged within the shell to the interior of the cylinder, which obviously adversely affects the energy and volumetric efficiency of the compressor.

OBJECTS OF THE INVENTION

It is an object of the present invention to reduce the metallic contact and the wear between the vane and the sliding slot without causing losses of the energy and volumetric efficiency of the compressor.

It is also an object of the present invention to present a solution which does not alter the normal operational conditions of the compressor.

BRIEF DESCRIPTION OF THE INVENTION

The rotary rolling piston compressor, which is the subject of the present invention, includes a hermetic shell in whose interior a cylinder is fixedly attached. A rolling piston having an eccentric part driven by a crankshaft rotates within the cylinder. The crankshaft is supported by a main bearing and a sub bearing and is driven by the rotor of an electric motor whose stator is fixed to the shell. The cylinder has a radial slot housing a vane with one end riding on the rolling piston surface and the other end biased by a spring. The vane defines, on each of its opposite sides, suction and compression chambers in the interior of the cylinder. The cylinder also has suction and discharge orifices.

According to the present invention the internal surface of at least one of the main bearing or sub bearing is provided with a groove disposed at an angle to the vane plane and having one of its ends in fluid communication with the interior of the compression chamber. The end of the groove on the suction chamber side is in fluid communication with a recess provided in the wall of the sliding slot surface, and extended in a transverse direction, preferably perpendicular, to the displacement direction of the vane.

With the construction of the vane sliding slot abovementioned, the existent pressure in the compression chamber is transferred, through the groove, up to the vane surface turned to the suction chamber side, exerting on this vane face an opposite force to the force exerted on the face turned to the compression chamber side, in a way to balance the transversal forces exerted on the vane due to the existing high pressure in the compression chamber.

The above characteristic considerably improves the vane load carrying capacity against the sliding slot, facilitating its reciprocating displacement and, making the smoother vane sliding against the slot surface by the suction side, especially in the area where would occur a greater wear due to metallic contact of the parts.

It should also be observed that the space between the vane and the discharge orifice of the compressor is, in normal operation, filled with oil especially at the end of the discharge cycle. On being so, the groove will be constantly filled with oil thereby improving the vane lubricating conditions.

In the present invention the oil is used in a hydraulic way to minimize the instability of transversal faces on the vane and also as a lubricant means in order to reduce even more the parts wear on the most loaded points.

With the invention, a substantial reduction is obtained on the metallic contact of parts and on the wear of the vane and sliding slot without causing any relevant increase of the temperature of the refrigerant fluid in the interior of the suction chamber. Also according to the invention, the oil leakage to the suction chamber only occurs during the last phase of the compression cycle and, the oil pressure corresponds to the compression pressure and not the discharge pressure. In this way, the oil quantity that flows away to the interior of the suction volume is quite a bit smaller, since the compression pressure is equal to the discharge pressure only at the end of the compression cycle when the discharge valve is open.

BRIEF DESCRIPTION OF THE DRAWINGS

The invention will be described as follows by making reference to the accompanying drawings, wherein.

DETAILED DESCRIPTION OF THE INVENTION

Figure 1:
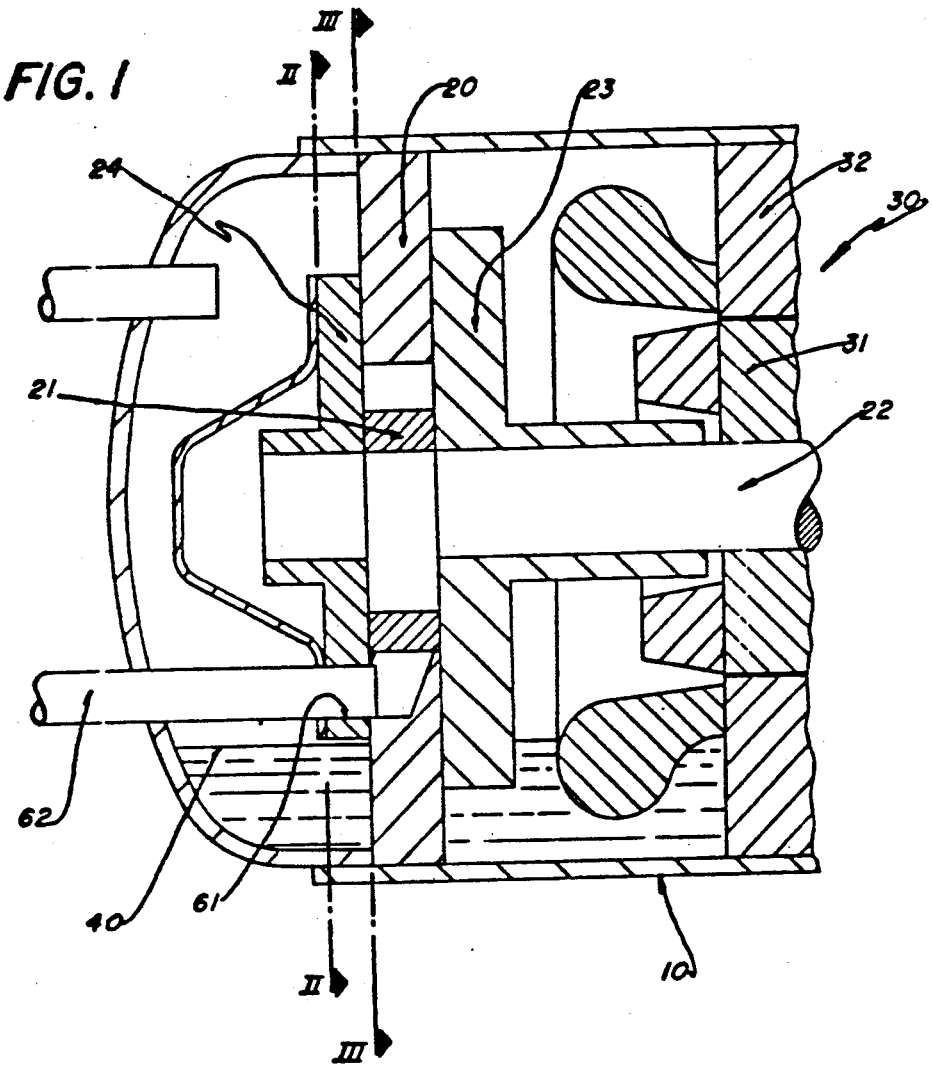
FIG. 1 is a cross sectional view of a rotary rolling piston type hermetic compressor in accordance with the present invention.

Referring to the drawings, the rotary compressor includes a hermetically sealed cylindrical shell 10 in whose interior an annular cylinder 20 is fixedly mounted. The shell also houses a rolling eccentric piston 21 driven by a crankshaft 22 which is supported by a main bearing 23 and a sub bearing 24.

The crankshaft 22 is driven by the rotor 31 of an electric motor whose stator is fixed on the interior wall of the shell 10.

Figure 4:
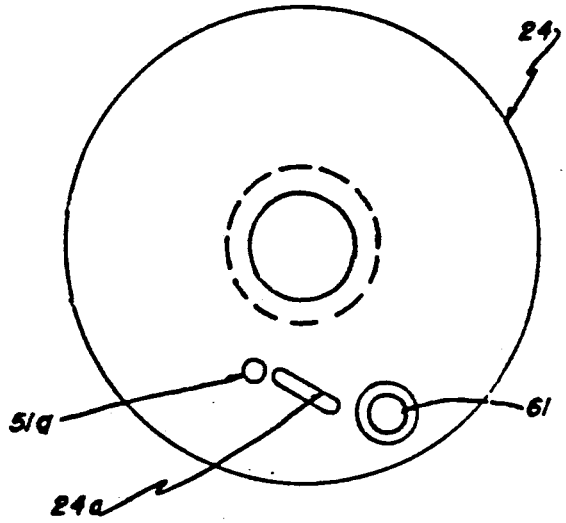
FIG. 4 is an internal plan view of the sub bearing.
Figure 2:
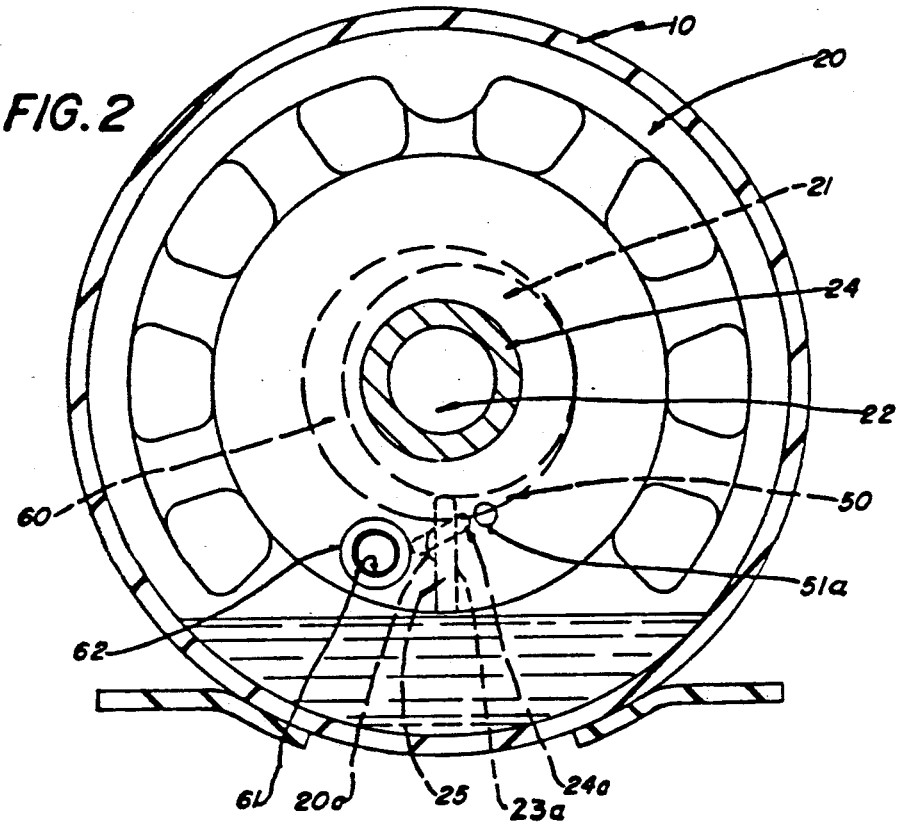
FIG. 2 is a cross sectional view of the compressor, taken according to line II—II of FIG. 1.
Figure 3:
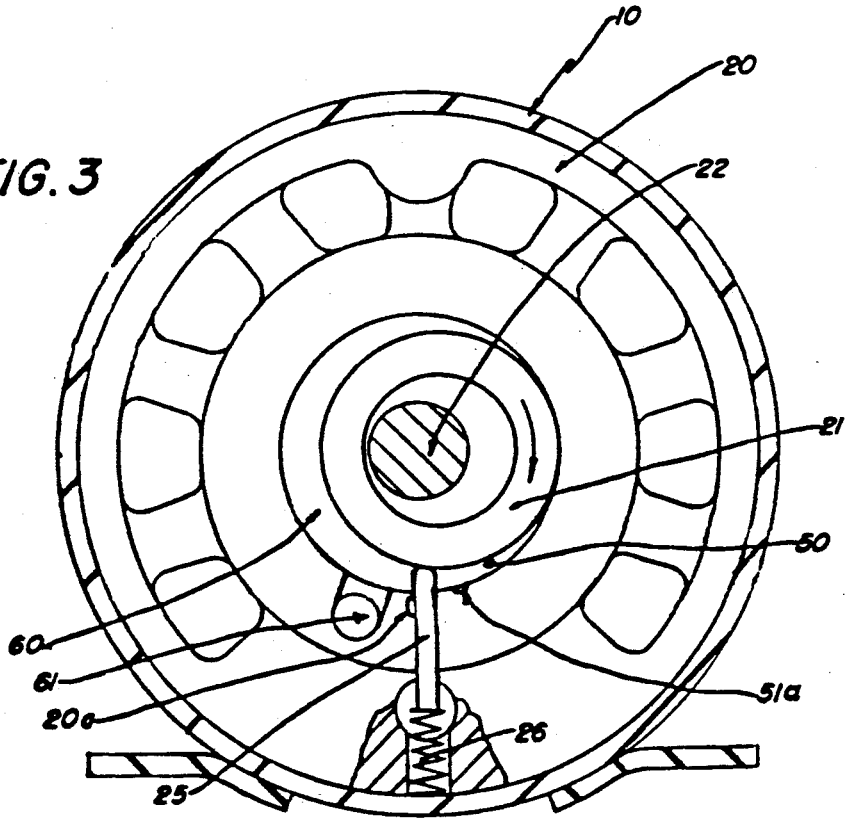
FIG. 3 is a cross sectional view of the compressor, taken according to line III—III of FIG. 1.

The wall of cylinder 20 is provided with a radial slot 23*a* near its inner edge in which a generally rectangular vane 25 is housed (see FIGS. 2 and 3). Vane 25 is constantly forced by a spring 26 (FIG. 4) to a sliding position with its free end riding on the rolling piston 21 eccentric surface, while it reciprocates in the abovementioned slot as the piston 21 rotates.

The lowest part of the interior portion of the shell 10 functions as a lubricant oil sump necessary to the lubrication of the mechanical components of the compressor.

As illustrated in FIGS. 2 and 3, the vane 25 defines, in the central interior of the cylinder 20 around the rolling piston 21 and between the internal faces of the main bearing 23 and sub bearing 24, a compression chamber 50. The wall of cylinder 20 has a discharge notch 51 (FIG. 3) which communicates with a discharge orifice 51*a* (FIG. 2) extending through the sub bearing 24. There is also a suction chamber 60 containing a suction hole 61 arranged through the sub bearing 24 and to which a suction tube 62 is connected (FIG. 1).

On the internal face of the sub bearing 24 a groove 24*a* (see FIG. 4) is formed defining a small channel in low relief. The groove 24*a* is arranged at an angle to the plane of vane 25 and has one of its ends in communication with the interior of the compression chamber 50 at a point close in front of the discharge orifice 51*a*, taking into consideration the displacement direction of the rolling piston 21 (see FIG. 2).

As seen, the groove 24*a* has the end on the compression chamber side placed in communication with or very close to the discharge orifice 51*a*. The other end of the groove or channel 24*a* on the side of the vane which communicates with the suction chamber is in fluid communication with a recess 20*a* formed in the cylinder sliding slot wall on the suction chamber 60 side. This recess 20*a* and its wall extends generally perpendicularly to the sliding direction of the vane 25, through the entire extent of the wall of the suction chamber 60.

The groove 24*a* also can be located on the other bearing or there can be a groove on each bearing.

In normal operation as the crankshaft rotates moving the piston eccentrically, the pressure at the exhaust chamber side builds up gradually, reaching a considerable pressure difference between the suction and exhaust chamber sides. This pressure difference between the two chambers will press the vane against the wall of the sliding slot on the suction chamber side.

With the use of the groove 24*a*, there is a fluid communication between the extreme end of the compression chamber and the recess 20*a* made in the wall of the sliding slot. In this way the smaller amount of force (pressure) acting on the vane from the suction chamber side will be augmented by the pressure from the compression chamber applied through groove 24*a* upon recess 20*a* on the suction chamber side of the vane. This tends to balance the force on the vane so that wear of the vane and the wall of the slot on the suction chamber side can be reduced.

I claim:

1. A rotary piston compressor comprising:

a housing, an annular cylinder mounted in said housing, an eccentric piston rotating within said cylinder, a crankshaft in aid housing supported by a spaced apart main bearing and a sub-bearing one on each side of said cylinder for rotating said piston which rotates in the space between the opposed faces of said main bearing and sub-bearing, a radial slot formed in the cylinder wall, a reciprocating vane disposed in said slot between the opposing faces of said main bearing and said sub-bearing, means for biasing said vane so that an end contacts the piston to be reciprocated thereby as the piston rotates, said vane defining with the interior of the cylinder and the surfaces of said main bearing and sub-bearing on one side a compression chamber and on the other side a suction chamber, one of said bearing shaving a discharge orifice in communication with said compression chamber and also having on its internal face an elongated groove or channel extending at an angel to the plane of the reciprocating vane with one end of the groove communicating with the pressure of said compression chamber at a point adjacent said discharge orifice and a part of the groove extending to the suction chamber side of the vane, and said cylinder having a recess communicating with said part of the groove on the suction chamber side and the slot for applying the pressure from the compression chamber as discharged to the orifice to the face of the vane along the suction chamber side to act to balance the pressure on the two sides of the vane.

2. A compressor as in claim 1 wherein the end of the groove in communication with the compression chamber pressure is located at a point spaced from the discharge orifice in the direction of rotation of the piston.

3. A compressor as in claim 1 wherein oil lubrication is provided to the cylinder interior, the oil in the cylinder compression chamber being provided to the slot and vane via said groove.

* * * * *